US006042018A

United States Patent [19]

Weinstein

[11] Patent Number: 6,042,018

[45] **Date of Patent: *Mar. 28, 2000**

[54] LIQUID DRINKING ASSEMBLAGE AND SYSTEM

[76] Inventor: Robert E. Weinstein, 177 Commonwealth Ave., Boston, Mass. 02116

[ * ] Notice: This patent is subject to a terminal disclaimer.

[21] Appl. No.: 09/178,602

[22] Filed: Oct. 26, 1998

[51] Int. Cl.[7] ..... A47G 21/18

[52] U.S. Cl. ..... 239/33; D7/300.2; 215/388; 220/705

[58] Field of Search ..... 239/16, 24, 33; 215/229, 387–389, 6; 220/705, 709, 553, 555, 23.2; 206/497; 222/94, 129; D7/300.2; 604/257; 229/103.1

[56] References Cited

U.S. PATENT DOCUMENTS

| | | | |
|---|---|---|---|
| D. 332,547 | 1/1993 | Lipson | D7/300.2 |
| D. 336,043 | 6/1993 | Provencio . | |
| 2,052,307 | 8/1936 | Kennedy . | |
| 2,531,855 | 11/1950 | Loptson . | |
| 3,260,462 | 7/1966 | Smaczny | 239/33 |
| 3,349,987 | 10/1967 | Weitzner . | |
| 4,699,318 | 10/1987 | Donatello et al. | 239/33 |
| 5,160,087 | 11/1992 | Mandell | 239/33 |
| 5,806,765 | 9/1998 | Weinstein | 239/33 |

*Primary Examiner*—Andres Kashnikow
*Assistant Examiner*—Lisa Ann Douglas
*Attorney, Agent, or Firm*—Morse & Altman

[57] ABSTRACT

An assemblage and system for drinking a plurality of potable and/or medicinal liquids simultaneously from discrete receptacles. The assemblage comprises a plurality of conduits joined together that convey isolated streams of the liquids from separate receptacles into the mouth. Preferably, the conduits are mechanically deformable along their axes of elongation. The conduits are joined by a catch, by binding, by molding the conduits as a single unit, by a joining structure, or by raveling. The system includes the assemblage and a number of joined receptacles.

8 Claims, 5 Drawing Sheets

LIQUID DRINKING ASSEMBLAGE AND SYSTEM

BACKGROUND OF THE INVENTION

1. Field of the Invention

The present invention relates to dispensers for potable liquids, more specifically, to apparatus for conveying more than one liquid into the mouth discretely and simultaneously.

2. The Prior Art

When eating solid foods, it is common to simultaneously place more than one food into the mouth, i.e. meat and potato on a fork. This practice allows the eater to combine foods to satisfy his or her personal tastes. By virtue of the integrity of solid food, it is also possible for the eater to place additional food in the mouth before swallowing. An example might be having meat in the mouth, then taking a bite of bread, chewing and swallowing both. This allows the eater to spontaneously combine foods in the mouth to suit his or her tastes.

In contrast to solid foods, it is difficult to take in a second beverage while one is already in the mouth. A person takes a drink by either lifting the drink container to the mouth or by using a straw to draw the beverage into the mouth. In the former case, it is extremely difficult to take a second drink before swallowing the first mouthful when the mouth is opened to take the second drink, the beverage already in the mouth will spill out. And in the latter case, it is very awkward to try to put the straw back into the mouth before swallowing the first mouthful. Either the straw must be pushed between clenched lips or the head must be tilted backwards to keep the beverage from spilling out.

One solution is to use two straws. There are several disadvantages to this. First, one must find two straws that are appropriate relative to each other. They may not have the necessary diameters or lengths. In addition, because the straws are not joined together, it is awkward to keep them fixed relative to each other, should it be desired.

Another solution is disclosed in U.S. Pat. No. 3,260,462, issued to Smaczny. Smaczny discloses a forked drinking straw, where there are two legs and a central tube. Each leg is inserted into a different container and the liquids are mixed either in the central tube or in a mixing chamber located at the junction of the legs and central tube prior to reaching the mouth. There are situations where mixing the liquids before reaching the mouth is not desirable. An example of such a case is when the combination creates an effervescent beverage, where, because of gas pressures, it would be dangerous to create the beverage in the confined space of a straw. Another example is when it is desired to taste the flavor of the different liquids separately and then combined.

Taste buds of a single type are grouped together and located in particular areas of the mouth. It is occasionally desirable to direct different components of a beverage to different locations in the mouth to take advantage of the location of particular types of taste buds. The Smaczny device will not work for this purpose because the beverage components are mixed prior to reaching the mouth. It is possible to use two separate straws for this purpose, but it is very awkward to hold the straws in fixed position relative to each other and relative to locations in the mouth and containers.

Thus, there is a continuing need for a device that can be used by a person to drink more than one liquid simultaneously such that the liquids are combined in the mouth and that can direct different liquids to different locations in the mouth simultaneously.

SUMMARY OF THE INVENTION

An object of the present invention is to provide an assemblage and system that facilitates the desire of a person to ingest potable and/or medicinal liquids from several containers simultaneously.

Another object is to provide an assemblage and system that allows a person to experience individual liquids separately and then combined.

A further object is to provide an assemblage and system that allows a person to combine several liquids in the mouth in a desired ratio.

A further object is to provide an assemblage and system that allows a person to simultaneously direct several liquids to different locations in the mouth.

To meet these objectives, the present invention has two basic embodiments: a drinking assemblage for drinking a plurality of potable and/or medicinal liquids simultaneously from isolated receptacles, and a system that combines the drinking assemblage with joined receptacles.

The drinking assemblage consists of a plurality of conduits joined so as to direct isolated streams of the liquids from receptacles into the mouth. Each conduit is composed of a material rigid enough so that the conduit will not bend over from the force of gravity when standing on end. A plastic will provide the assemblage with a long useful life and a coated paper will provide the assemblage with a low manufacturing cost.

Typically, the conduits will have the same length. The length of one or more may be shortened in order to customize the assemblage for a particular use. The cross-sectional shape may be formed into any desired shape, but is typically round. The cross-sectional area of the conduits are typically the same, but can be formed to regulate the amount of each liquid reaching the mouth at the same time or to accommodate liquids of differing densities. Optionally, the cross-sectional area can be controlled dynamically by pinching the conduit walls. In this way, the proportion of liquids reaching the mouth can be changed dynamically to accommodate the tastes of the drinker.

The conduit may be longitudinally rigid or mechanically deformable by applying force. In the rigid embodiment, the conduit will maintain its longitudinal shape under a moderate amount of stress. In one deformable embodiment, the conduit does not maintain the deformed shape after the force is removed. In another deformable embodiment, the deformed shape is maintained. One way to maintain the deformed shape is to provide the conduit with a bellows, a device well known in the art.

The conduits are joined together while maintaining the isolation of the liquids prior to reaching the mouth. Preferably, the joint is robust enough so that the conduits remain joined together under a modest amount of stress. The joint can be anywhere along the length of the conduits. The conduits are joined by either joining already existing conduits together or by forming the conduits as a single unit.

The drinking system of the second embodiment consists of a drinking assemblage and joined receptacles. The drinking assemblage is substantially the same as the drinking assemblage described above.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 1:
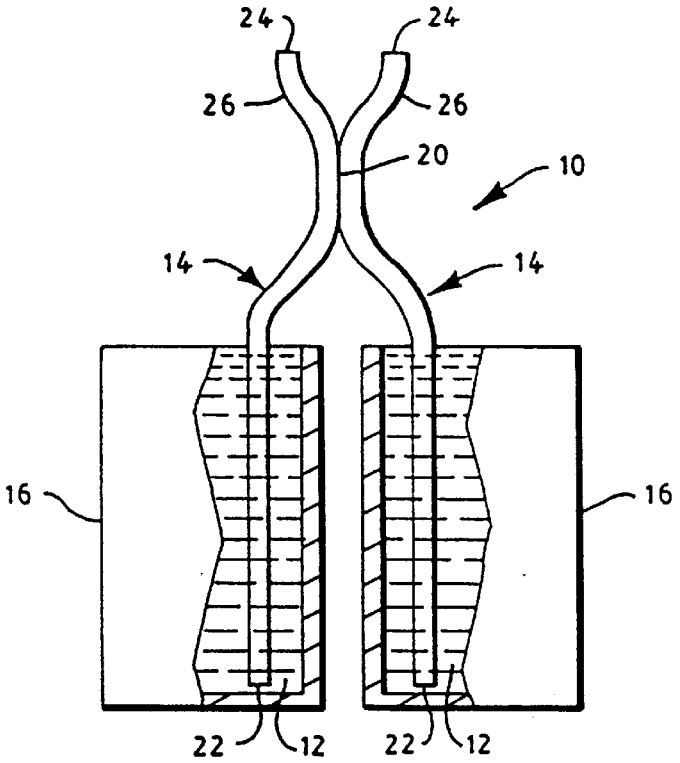
FIG. 1 is a cut-away side view of the first embodiment of the present invention.

The present invention has two basic embodiments. The first is an assemblage for drinking a plurality potable and/or medicinal liquids simultaneously from isolated receptacles. The second embodiment is a system that combines the drinking assemblage with joined receptacles.

Drinking Assemblage of FIGS. 1–10

The drinking assemblage 10 consists of a plurality of conduits 14 joined together. The conduits 14 conduct isolated streams of the liquids 12 from a plurality of receptacles 16 into the mouth, where the liquids 12 combine in the desired manner.

The receptacle configuration and the intended use of the assemblage determines the various parameters of the assemblage 10, including the material of which it is composed, the number of conduits 14, the length of the conduits 14, and the radial cross-sectional shape and area of the conduits 14.

The conduit 14 is preferably composed of a material that is somewhat flexible. The use to which the assemblage 10 will be put determines the material from which the conduit 14 it is made. A semi-rigid plastic, such as polyethylene or polypropylene, will provide the assemblage 10 with a long useful life and the ability to withstand the high temperatures needed to cleanse and disinfect the assemblage 10 for future use.

A coated paper will provide the assemblage 10 with a short life, typically for one use only, but is less expensive to manufacture than a plastic assemblage. The coating prohibits the liquid from soaking into the paper and is preferably a wax or plastic.

Typically, the conduits 14 will have the same length, the length being defined as the linear distance between the ingress 22 and egress 24 of the conduit 14. If the receptacles 16 have different depths, the conduit lengths may be different. In addition, any of the conduits 14 may be shortened in order to customize the assemblage 10 for a particular use.

The preferred cross-sectional shape of each conduit 14 is round. However, any shape may be used, such as semicircular, square or octagonal and different conduits 14 of the same assemblage 10 may have different shapes. The selection of the appropriate cross-sectional shape for a given application depends upon a number criteria, including the use being made of the assemblage 10, the number of conduits 14 attached together to form the assemblage 10, how the conduits 14 are joined together, and the market at which the assemblage 10 is targeted.

Different conduits 14 of the same assemblage 10 may have different cross-sectional areas, which can be used to regulate the relative amounts of the liquids 12 reaching the mouth at the same time. The cross-sectional area determines the flow of liquid 12 through the conduit 14 for a given amount of force. A smaller cross-section will provide less liquid 12 than a larger cross-section with the same amount of force.

Another factor in determining the cross-sectional area of each conduit 14 is the density of the liquids 12 with which the assemblage 10 will be used. For example, a conduit 14 for use with water does not have to be as large as a conduit 14 used for a syrup in order to convey the same amount of each, because a syrup is thicker than water.

Optionally, the cross-sectional area can be controlled by squeezing and releasing the walls 26 of the conduit 14. In one embodiment, the cross-section will substantially maintain its shape after the squeezing pressure is released. In another embodiment, the cross-section of a plastic conduit 14 will return substantially to its original shape when released. This later ability allows the drinker to dynamically regulate the flow of liquid 12 in the conduit 14 by squeezing and releasing the conduit wall 26 with the fingers. In this way, different amounts of the liquids 12 can be mixed, dynamically changing the flavor of the liquid combination to suit the drinker.

Optionally, the conduit 14 is mechanically deformable by applying force so that the linear shape can be adjusted for a particular use. In one embodiment, the conduit 14 does not maintain the deformed shape after the force is removed. In another embodiment, the deformed shape is maintained.

The assemblage 10 is a combination of two or more conduits 14 that are joined together while maintaining the isolation of the streams of liquids 12. The contact area 20 should be robust enough so that the conduits 14 remain joined together under a modest amount of stress.

The conduits 14 may be joined together in any orientation. At one extreme, the longitudinal axes of the conduits 14 are parallel at the contact area 20, as in FIG. 1. At the other extreme, the axes at the contact area 20 are perpendicular, as in portions of FIG. 10.

The location of the contact area 20 is also determined by the intended use of the assemblage 10. If the liquids 12 are to be combined immediately upon entry into the mouth, the contact area 20 can be adjacent to the egresses 24. For other uses, the contact area 20 can be away from the egresses 24, as in FIG. 1.

Figure 2:
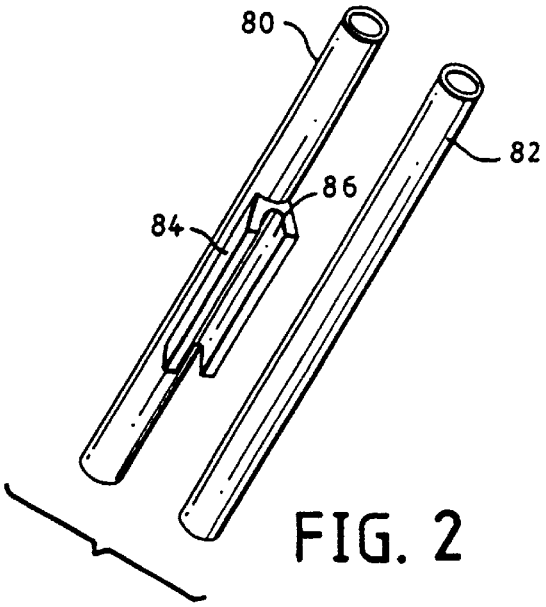
FIG. 2 is an perspective view of one alternative of the joining of two conduits by interlocking.

In the drinking assemblage 10, the conduits 14 are joined in close proximity in at least one of a number of ways. The first is to join the conduits 14 together by catches after being individually formed. For example, as shown in FIG. 2, one conduit 80 has a longitudinal protrusion 84 with a longitudinal cylindrical depression 86. The depression 86 is sized to snap around the circumference of another conduit 82 and to maintain a junction with the other conduit 82 under a modest amount of pressure. The conduits 80, 82 may be separated by pulling them apart to overcome the snap action of the depression 86.

Figure 3:
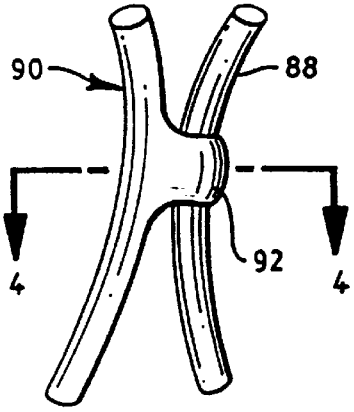
FIG. 3 is an perspective view of a second alternative of the joining of two conduits by interlocking.
Figure 4:
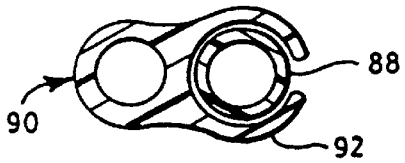
FIG. 4 is a cross-sectional view of FIG. 3 along the line 4—4.

In a first alternative, shown in FIGS. 3 and 4, one conduit 90 is molded around an already existing conduit 88. An already existing first conduit 88 is placed into the mold for forming a second conduit 90. The mold is shaped so that an element 92 of the second conduit 90 encompasses a portion of the first conduit 88. Whether or not the conduits 88, 90 can be separated after molding depends on how much of the circumference of the first conduit 88 is encompassed and on how flexible the second conduit material is.

Figure 5:
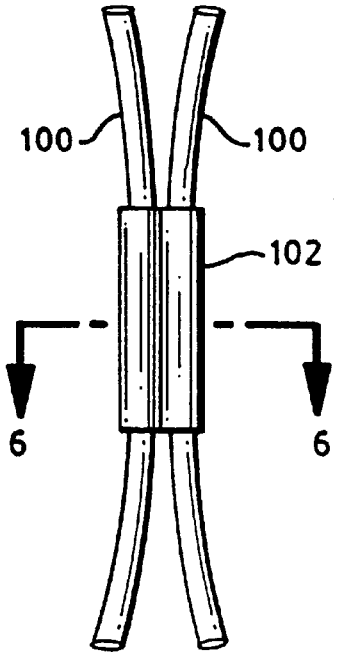
FIG. 5 is a side view of another alternative of the joining of two conduits by interlocking.
Figure 6:
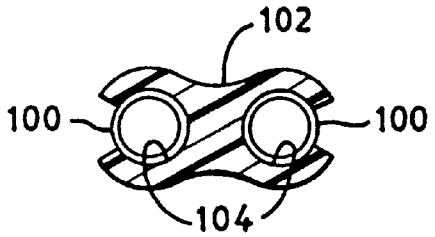
FIG. 6 is a cross-sectional view of FIG. 5 along the line 6—6.

In a second alternative, shown in FIGS. 5 and 6, the two conduits 100 are joined by a joining structure 102 that includes opposed longitudinal cylindrical depressions 104. Each depression 104 is sized to snap around the circumference of a conduit 100 and to maintain a junction with the conduit 100 under a modest amount of pressure. The conduits 100 may be inseparable, or each conduit 100 may be separated from the joining structure 102 by pulling it from the joining structure 102 to overcome the snap action of the depression 104.

Figure 7:
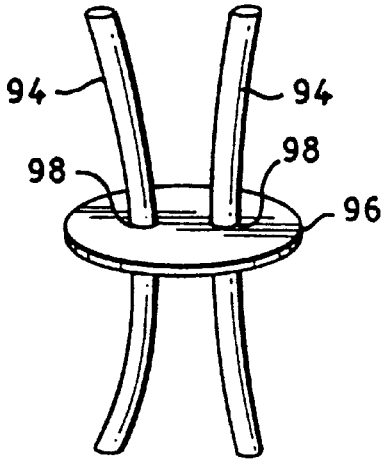
FIG. 7 is a side view of another alternative of the joining of two conduits by interlocking.

In a third alternative, shown in FIG. 7, the two conduits 94 are joined by a planar joining structure 96 that includes a pair of apertures 98 in close proximity to each other. Each aperture 98 is sized to hold a conduit 94 that has been pushed into it. The conduits 94 may be inseparable, or each conduit 94 may be separated from the joining structure 96 by pulling it from the aperture 98.

The second method is to cement or weld the conduits 14 together after being individually formed. Cementing can be used with both plastic and coated paper conduits 14. If the conduits 14 are composed of plastic, they may be welded together such as by applying heat at the contact area 20 and "melting" the conduits 14 together. There are several advantages offered by joining the conduits 14 after they are formed. These include the ability to create small lots of specialized assemblages 10 and the ability to create shapes that cannot be created by molds.

In the third method, the assemblage 10 is formed as a single unit, where the conduits 14 are already joined together. Depending upon where along the conduits 14 they are joined, this may be a more practical approach than forming the conduits 14 and joining them later. The conduits 14 are preferably formed in a mold. Different molds can be made to create assemblages 10 with a varying numbers of conduits 14 joined at different locations along their outside surfaces 26. In this way, special configurations of the conduits 14 can be made. Molding will work easily only with plastic conduits 10; it is not practical for use with coated paper.

Figure 8:
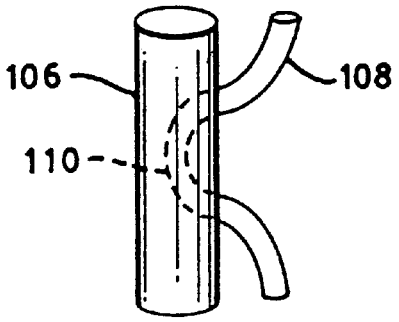
FIG. 8 is a perspective phantom view of the joining of two conduits by molding.

In one configuration of this method, the conduits are joined at their outer surface, as shown in FIG. 1. Alternatively, the conduits are joined in an overlapping manner, as shown in FIG. 8, where a portion 110 of one conduit 108 is inside the other conduit 106.

Figure 9:
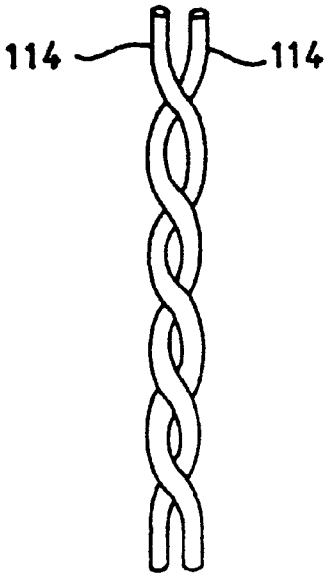
FIG. 9 is a side view of one alternative of the joining of two conduits by raveling.
Figure 10:
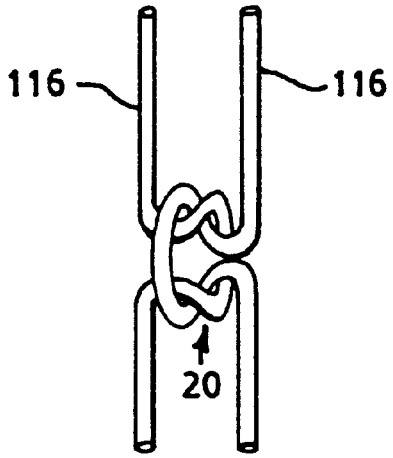
FIG. 10 is a side view of another alternative of the joining of two conduits by raveling.

In the fourth method, shown in FIGS. 9 and 10, the two conduits are formed independently and raveled about each other to form a junction. In some cases, like that of FIG. 9, the conduits 114 can be formed into their final shape and then twisted together. In other cases, like that of FIG. 10, the conduits 116 may be softened so that they can be bent, twisted or knotted together, and allowed to cool.

The present invention also contemplates that any combination of the above-described joining methods may be employed simultaneously.

Figure 11:
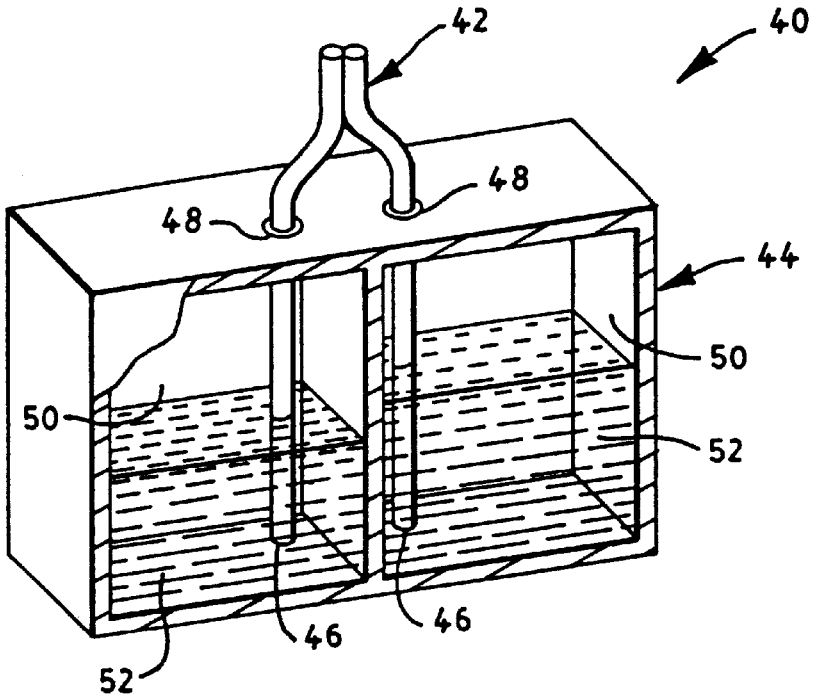
FIG. 11 is a cut-away perspective view of one configuration of the second embodiment of the present invention.
Figure 12:
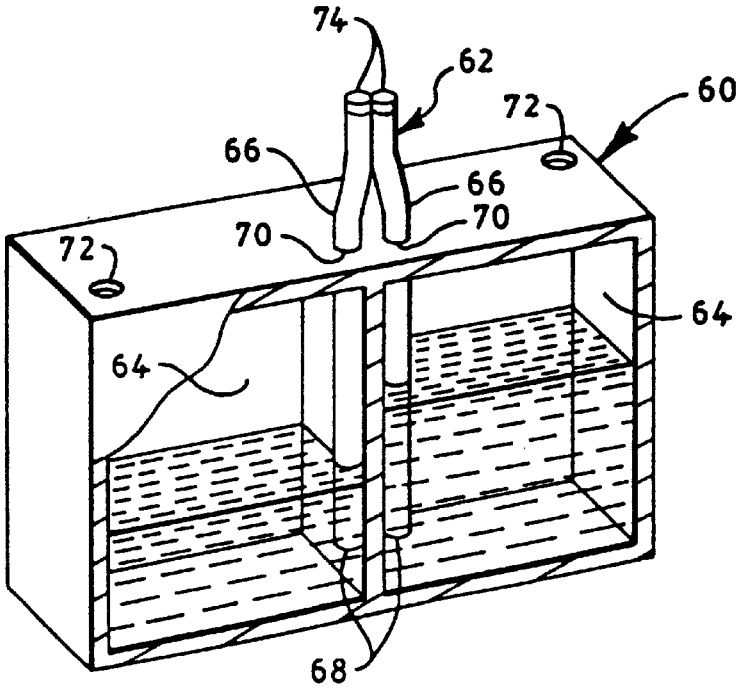
FIG. 12 is a cut-away perspective view of another configuration of the second embodiment.
Figure 13:
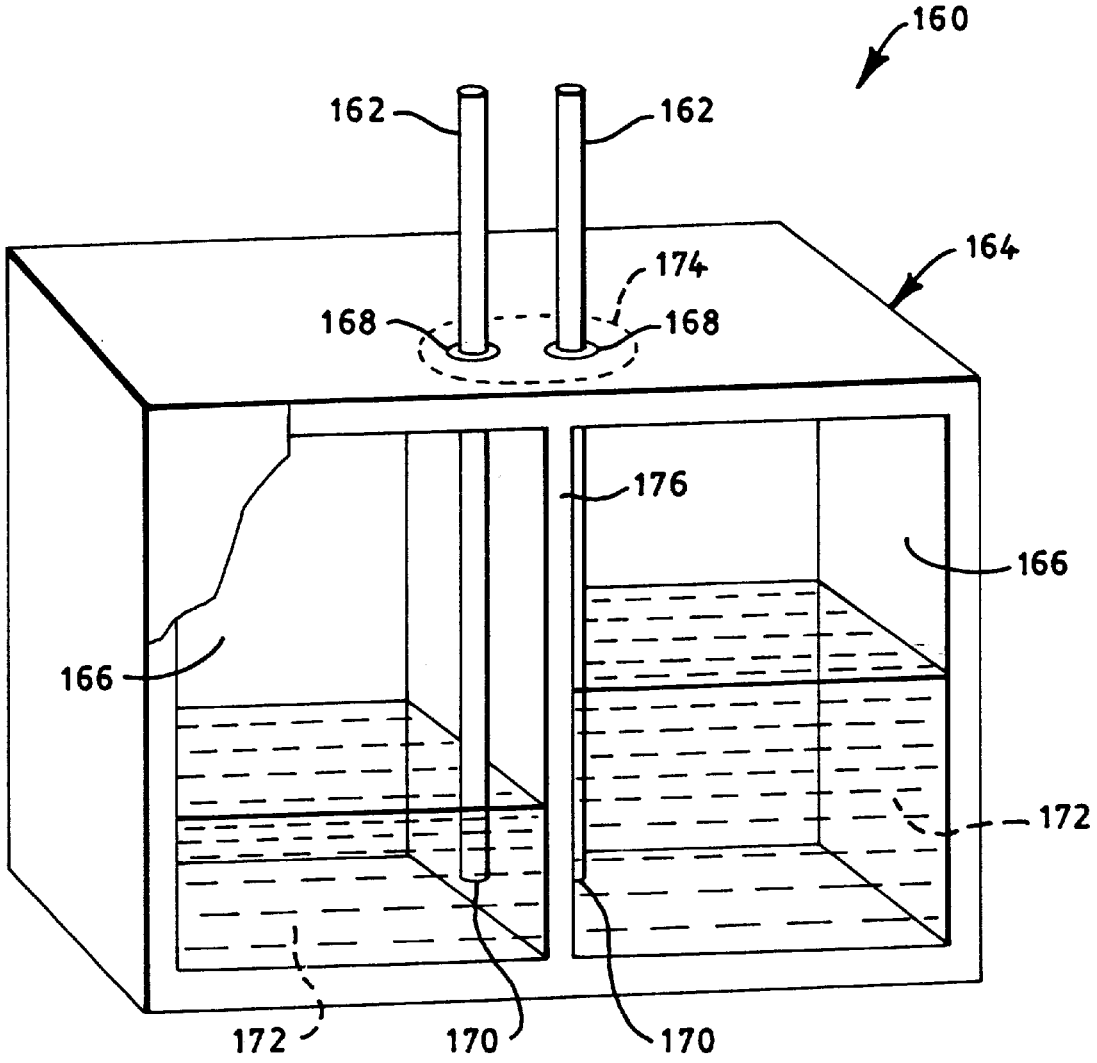
FIG. 13 is a cut-away perspective view of another configuration of the second embodiment.

The Drinking System of FIGS. 11–13

In the second embodiment of the present invention, joined conduits are one component of a drinking system, which includes joined receptacles for storing the liquids for drinking. In one configuration, the liquid-storing compartments of the receptacles are separated by a single wall between them. In another configuration, external surfaces of individual receptacles are adhered together to join the receptacles. In another configuration, individual receptacles are joined by wrapping their external surfaces together, such as with tape or cellophane. In yet another configuration, the receptacles are joined within a container. Other methods of joining receptacles are possible, with other resulting configurations, and all are contemplated for use with the present invention.

The receptacles may be single-use or refillable. They may be prefilled by the supplier or filled by the drinker. Many different configurations of receptacles are possible and all are contemplated for use with the present invention.

There are three configurations of the system embodiment. In the first configuration 40, shown in FIG. 11, the drinking assemblage 42 is separate but packaged with the container 44. The system 40 is designed so that the user inserts the conduit ingresses 46 through apertures 48 in the receptacles 50 into the liquid 52 when ready to drink. Prior to inserting the ingresses 46, the apertures 48 are covered to prevent spillage and/or contamination of the liquid 52.

In the second configuration, an example of which is shown in FIG. 12, the system 60 is manufactured with the assemblage 62 positioned permanently in the receptacles 64. The conduits 66 are formed with the receptacles 64 such that the ingress 68 communicates with the liquid in the receptacle 64 and the conduit 66 exits the receptacle 64 through a water-tight aperture 70. Preferably, there is an opening 72 in the top wall of each receptacle 64 that allows air into the receptacle 64 during drinking in order to equalize pressure. Alternatively, the receptacles are composed of materials that allow them to collapse as liquid is removed in order to equalize pressure. The conduit egresses 68 are capped to prevent spillage and/or contamination. The cap 74 is removable by the user prior to drinking. The pressure openings 72 are covered to prevent spillage and/or contamination and are opened by the user prior to drinking.

In the third configuration 160, shown in FIG. 13, each receptacle 166 includes an aperture 168, where all of the apertures 168 are in close proximity to each other and to the common wall 176. The system 160 is designed so that the user inserts the ingresses 170 of the conduits 162 through the apertures 168 into the liquid 172 when ready to drink. Optionally, the conduits 162 may be fixed in the apertures 168 so that they cannot be easily removed. The portion of the container 164 that immediately surrounds the apertures 168 and straddles the common wall 176, shown as a dotted circle 174, is equivalent to the joining structure 96 described above with reference to FIG. 7. Typically, provision must be made for equalization of pressure, such as making the receptacles collapsible or including air openings.

Thus it has been shown and described a drinking assemblage and system which satisfy the objects set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A drinking assemblage for enabling a person to ingest streams of potable or medicinal liquids simultaneously from a plurality of receptacles into a plurality of oral locations, said drinking assemblage comprising:

(a) a plurality of conduits, each having an ingress, an egress, and an axis of elongation;

(b) said conduits being joined in close proximity to each other by a joining structure such that said egress is free to be separated from all other of said egresses, thereby adapting said drinking assemblage for directing said liquids to said plurality of oral locations;

(c) said ingresses being adapted for communication respectively with said liquids within said plurality of receptacles;

(d) said egresses being adapted for communication respectively with said plurality of oral locations; and (e) said conduits being adapted to isolate said liquids from each other when in said conduits.

2. A drinking assemblage for enabling a person to ingest streams of potable or medicinal liquids simultaneously from a plurality of receptacles into a plurality of oral locations, said drinking assemblage comprising:

(a) a plurality of conduits, each having an ingress, an egress, and an axis of elongation;

(b) each of said conduits being joined to at least one other of said conduits by raveling said conduits together such that said egress is free to be separated from all other of said egresses, thereby adapting said drinking assemblage for directing said liquids to said plurality of oral locations;

(c) said ingresses being adapted for communication respectively with said liquids within said plurality of receptacles;

(d) said egresses being adapted for communication respectively with said plurality of oral locations; and (e) said conduits being adapted to isolate said liquids from each other when in said conduits.

3. A drinking system for enabling a person to ingest streams of potable or medicinal liquids into a plurality of oral locations, said drinking system comprising:

(a) a plurality of joined receptacles adapted for holding said liquids, each of said receptacles having an opening;

(b) a drinking assemblage including a plurality of conduits, each of said conduits having an ingress, an egress, and an axis of elongation;

(c) said conduits being joined in close proximity to each other by a joining structure such that said egress is free to be separated from all other of said egresses, thereby adapting said drinking assemblage for directing said liquids to said plurality of oral locations;

(d) said ingresses being adapted for communication respectively with said liquids within said plurality of receptacles;

(e) said egresses being adapted for communication respectively with said plurality of oral locations; and (f) said receptacles and said conduits being adapted to isolate said liquids from each other when in said receptacles and said conduits.

4. The drinking system of claim 3 wherein said receptacles are joined by a common wall.

5. The drinking system of claim 3 wherein said receptacles are joined within a container.

6. A drinking system for enabling a person to ingest streams of potable or medicinal liquids into a plurality of oral locations, said drinking system comprising:

(a) a plurality of joined receptacles adapted for holding said liquids, each of said receptacles having an opening;

(b) a drinking assemblage including a plurality of conduits, each of said conduits having an ingress, an egress, and an axis of elongation;

(c) each of said conduits being joined to at least one other of said conduits by raveling said conduits together such that said egress is free to be separated from all other of said egresses, thereby adapting said drinking assemblage for directing said liquids to said plurality of oral locations;

(d) said ingresses being adapted for communication respectively with said liquids within said plurality of receptacles;

(e) said egresses being adapted for communication respectively with said plurality of oral locations; and (f) said receptacles and said conduits being adapted to isolate said liquids from each other when in said receptacles and said conduits.

7. The drinking system of claim 6 wherein said receptacles are joined by a common wall.

8. The drinking system of claim 6 wherein said receptacles are joined within a container.

* * * * *